US005460928A

United States Patent [19]

Kam-Ng et al.

[11] Patent Number: 5,460,928

[45] Date of Patent: Oct. 24, 1995

[54] PHOTOGRAPHIC ELEMENT CONTAINING PARTICULAR BLUE SENSITIZED TABULAR GRAIN EMULSION

[75] Inventors: Mamie Kam-Ng, Fairport; Drake M. Michno; John D. Buhr, both of Webster, all of N.Y.

[73] Assignee: Eastman Kodak Company, Rochester, N.Y.

[21] Appl. No.: 228,462

[22] Filed: Apr. 15, 1994

[51] Int. Cl.[6] ..... G03C 7/00

[52] U.S. Cl. ..... 430/503; 430/359; 430/556; 430/557; 430/567; 430/570; 430/581; 430/583

[58] Field of Search ..... 430/502, 503, 430/556, 557, 567, 570, 581, 583, 359

[56] References Cited

U.S. PATENT DOCUMENTS

| | | | |
|---|---|---|---|
| H1243 | 10/1993 | Shimba et al. | 430/508 |
| 3,672,898 | 6/1972 | Schwan et al. | 96/74 |
| 3,752,670 | 8/1973 | Needler et al. | 96/74 |
| 3,753,721 | 8/1973 | Millikan et al. | 96/130 |
| 3,847,613 | 11/1974 | Kaiichiro et al. | 96/74 |
| 3,976,492 | 8/1976 | Hinata et al. | 96/100 |
| 3,982,950 | 9/1976 | Shiba et al. | 96/139 |
| 4,018,610 | 4/1977 | Hinata et al. | 96/124 |
| 4,040,841 | 8/1977 | Hinata et al. | 96/126 |
| 4,199,360 | 4/1980 | Hinata et al. | 430/503 |
| 4,232,118 | 11/1980 | Okauchi et al. | 430/574 |
| 4,425,425 | 1/1984 | Abbott et al. | 430/502 |
| 4,435,501 | 3/1984 | Maskasky | 430/434 |
| 4,439,520 | 3/1984 | Kofron et al. | 430/434 |
| 4,469,785 | 9/1984 | Tanaka et al. | 430/572 |

(List continued on next page.)

FOREIGN PATENT DOCUMENTS

| | | |
|---|---|---|
| 39 25 334 | 2/1990 | Germany . |
| 4073-620 | 11/1977 | Japan . |
| 4069-429 | 11/1977 | Japan . |
| 9116-645 | 12/1982 | Japan . |
| 2153-850 | 12/1985 | Japan . |
| 1202-746 | 2/1988 | Japan . |
| 1418963 | 9/1973 | United Kingdom . |

OTHER PUBLICATIONS

Research Disclosure 18716, Nov. 1979, Sidney C. Wheat, Photographic Products, pp. 647–651.

Journal of Applied Photographic Engrg, vol. 5, No. 2, Spring 1979, E. Groll, D. Hill, W. Severin, Modern Exposure Determination for Customizing Photofinishing Printer Response, pp. 93–104.

*Primary Examiner*—Charles L. Bowers, Jr.
*Assistant Examiner*—Geraldine Letscher
*Attorney, Agent, or Firm*—Gordon M. Stewart

[57] ABSTRACT

A color photographic element has a blue sensitive tabular grain silver halide emulsion layer the halide content of which is less than 80% chloride and which has a tabularity of at least 8. The foregoing emulsion is sensitized such that the wavelength of maximum sensitivity of the emulsion between 400–500 nm ("$\lambda_{Bmax}$"), the sensitivity at 485 nm ("$S_{485}$"), the sensitivity at 410 nm ("$S_{410}$"), and the sensitivity at $\lambda_{Bmax}$ ("$\lambda_{Bmax}$"), are defined by:

$$430\text{ nm} \geqq \lambda_{Bmax} \geqq 440\text{ nm or } 450\text{ nm} \geqq \lambda_{Bmax} \geqq 480\text{ nm}$$

and $$S_{485} \geqq 50\%\ (S_{Bmax})$$

$$S_{410} \geqq 60\%\ (S_{Bmax})$$

and the maximum sensitivity of the emulsion between 430–440 nm ("$S_{(430-440)max}$"), and the maximum sensitivity between 450–480 nm ("$S_{(450-480)max}$"), have the following relationship:

$$90\%\ (S_{(450-480)max}) \geqq S_{(430-440)max} \geqq 110\%(S_{(450-480)max}).$$

The above element is particularly useful in a process of printing a color negative on an automatic printer which compensates for color saturation of a subject negative relative to a standard negative.

9 Claims, 2 Drawing Sheets

U.S. PATENT DOCUMENTS

Figure 1:
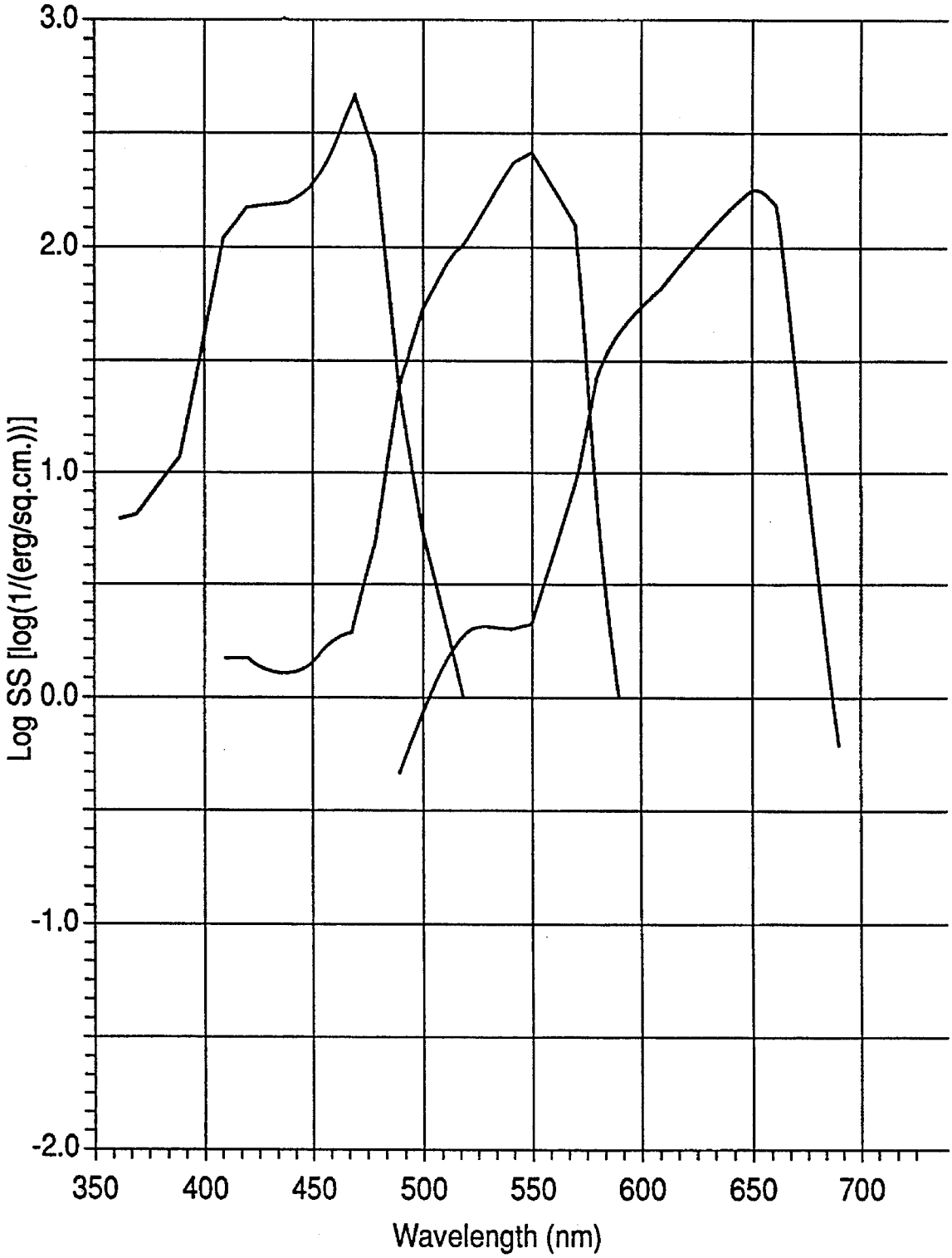

| | | | |
|---|---|---|---|
| 4,582,786 | 4/1986 | Ikeda et al. | 430/577 |
| 4,587,195 | 5/1986 | Ishikawa et al. | 430/139 |
| 4,609,621 | 9/1986 | Sugimoto et al. | 430/567 |
| 4,770,983 | 9/1988 | Ogawa et al. | 430/505 |
| 4,837,140 | 6/1989 | Ikeda et al. | 430/550 |
| 4,894,319 | 1/1990 | Ikeda et al. | 430/383 |
| 4,920,042 | 4/1990 | Waki et al. | 430/380 |
| 4,939,078 | 7/1990 | Kuramoto et al. | 430/505 |
| 4,942,121 | 7/1990 | Kajiwara et al. | 430/583 |
| 4,952,491 | 8/1990 | Nishikawa et al. | 430/570 |
| 5,024,928 | 6/1991 | Loiacono et al. | 430/504 |
| 5,037,728 | 8/1991 | Shiba et al. | 430/505 |
| 5,180,657 | 1/1993 | Fukazawa et al. | 430/503 |
| 5,206,124 | 4/1993 | Shimazaki et al. | 430/503 |
| 5,272,048 | 12/1993 | Kim et al. | 430/503 |

PHOTOGRAPHIC ELEMENT CONTAINING PARTICULAR BLUE SENSITIZED TABULAR GRAIN EMULSION

FIELD OF THE INVENTION

This invention relates to a photographic element which has a blue sensitive layer with a tabular grain emulsion sensitized to have a defined blue spectral sensitivity profile. This invention also relates to a method of producing prints from the foregoing element following exposure and processing, on an automatic printer of a type which adjusts exposure during printing based on differences between color saturation of a subject negative and a standard negative.

BACKGROUND OF THE INVENTION

Typical color photographic negatives have three records which are sensitive to respective areas of the visible light spectrum, namely red, green and blue. Each record is usually made up of one or more layers each containing a light sensitive silver halide emulsion. These records also contain couplers which imagewise produce cyan, magenta and yellow dyes, respectively. In a color negative film, the records are usually arranged on a support in the order of red, green and blue sensitive records (that is, the blue sensitive record is furthest from the support).

Conventional silver halide emulsions usually have grains which are primarily cubic, octahedral, cubo-octahedral or polymorphic in shape. Such grains typically have an inherent sensitivity to visible light in the region of about 400–430 nm. Therefore, sensitizing dyes are used on the emulsions to sensitize them to the required red and green region of the spectrum. Optionally, a blue sensitizing dye can be used to provide sensitivity to the 450–500 nm region of the visable spectrum. Such conventional shaped grains, while not necessarily requiring sensitizing dyes to provide sensitivity in the blue region of the visible spectrum, contribute to optical degradation of the image being captured by the underlying green and red records.

Tabular grain emulsions are known for use in the blue sensitive layer of a color negative film. Tabular grains, when present in the blue sensitive layer, result in improved transmission of incident light to the underlying green and red sensitive layers. In order to provide practical photographic efficiency, such grains are typically sensitized in the 450–500 nm region by a spectral dyeing technique to yield blue sensitive emulsions as high tabularity, low bulk iodide tabular grains have relatively little inherent sensitivity in the 400–500 nm range. By spectrally sensitizing these emulsions where there exists a higher number of photons per unit energy (that is, between 450–480 nm of the blue region), the sensitivity and hence the efficiency of the blue sensitive record containing these elements is maximized. However this is not without consequence as discussed below.

Following imagewise exposure and chromogenic processing, the dye image (the negative) thus obtained is usually printed onto a receiving element (typically having a paper base although other supports or media such as those used in digital image manipulation are applicable) to yield a positive image.

Automatic printers, common to the art of modern photofinishing, have been developed to attain rapid and economical printing from color (dye image) negatives. Well designed printers have one large area sensor or any number of smaller sensors with red, green and blue sensitivities that are used by the printer algorithm to assess the red, green and blue densities, integrated over the entire negative, in effectively the same way as does a photographic paper which is used in the printer. Color negative films are designed so that, for a specific taking (exposing) illuminant (typically daylight), a specified red, green and blue density relationship is effected when a uniform neutral (typically gray) target is photographed. Automatic printers, in turn, are set up so that this red, green and blue density relationship of a standard negative (when exposed with a gray target under the design illuminant) are recognized as being a neutral exposure. Thus, for such a negative, the integrated red, green and blue density relative to a gray center, referenced as D', is given a value of D'=0. In any printer this leads to adjustment of the appropriate red, green or blue light exposures of the subject negative to the print (for example, by controlling the duration or intensity of those colors through the use of direct control of the light source(s) and/or filters), to yield a perfect gray print balance. The controlling logic, or algorithms, used by automatic printers further assumes that even though most scenes are composed of objects of many colors, most photographed scenes integrate to a near neutral gray.

However, when such an automatic printer encounters an exposed negative for which D' is not equal to zero, the printer algorithm is designed to alter (or "correct") the red, green and/or blue light exposure, in a manner which depends on the value of D'. The degree to which this correction is applied varies depending on the particular printer algorithm used. Due to the diverse causes of color bias, well designed printers do not apply 100% correction. Simple algorithms apply some smaller correction, often 50% to minimize the chances of removing all the color bias in the film which can significantly alter the appearance of captured scenes which do not integrate to gray. More complex algorithms alter the amount of correction depending on the color bias direction-(hue) to make a more intelligent assessment as to how much of the bias to correct based on known hue-dependent bias causes. The operation of such algorithms is described in "Modern Exposure Determination for Customizing Photofinishing Printer Response" by E. Goll, D. Hill, and W. Severin, published in *Journal of Applied Photographic Engineering,* Vol 5, Number 2, pages 93–104, 1979.

By the foregoing process the automatic printer attempts to remove some or all of the color bias (that is, the degree to which D' differs from O, sometimes referenced in this application as "saturation" of a negative) recognized by the printer in the film frame. The goal of the printer is to reduce in the print as much as possible, all the color bias in the negative to be printed except that caused by the objects in the scene itself and occasionally some of the bias caused by the scene illuminant (as in pictures taken at sunset) so that the printed reproduction appears to the viewer as the original scene is remembered.

It would be desirable to provide a color negative which uses a tabular grain emulsion in the blue sensitive layer, and which can be printed in automatic printers of the above described type and produce prints which have low objectionable color bias even though the negative may have been exposed under different lighting conditions, and particularly under fluorescent lighting.

SUMMARY OF THE INVENTION

The present invention realizes that the overall color quality of prints made from automatic printers depends upon the relative amounts of red, green and blue densities in the processed negative, as well as how the automatic printer algorithm interprets these densities. The key to designing a film which will allow the printer to introduce the minimum amount of color bias in the resulting print is to remove sources of variability which produce negatives with inappropriate red, green and blue densities. One such source of variabilty which contributes to prints with high and objectionable color bias is the spectral misinterpretation of the scene illuminant by the negative.

For silver bromide and silver bromoiodide tabular grains which possess high tabularity and relatively low bulk iodide content, the use of a sensitizing dye which imparts responsiveness or sensitivity in the 450 to 480 nm region of the visable spectrum, while offering advantage with respect to specular imaging, leaves the color negative film which contains these elements at risk of producing prints from automatic printers which contain an objectionable color bias under certain circumstances. The source of this bias is the result of spectral mis-alignment of the scene illuminant and the spectral sensitivity of the color negative film containing these emulsions. In particular, light sources such as fluorescent, mercury vapor lamps and others which rely upon a strong narrow emission at about 435 nm to emulate a metamerically perceived white light, can lead to significant color bias in the final print generated by means of an automatic printer.

The present invention realizes that the key to designing a film which will allow the printer to produce the minimum amount of incorrect color correction in the resulting prints due to scene illuminant variation is to minimize the printer saturation parameter, D'. Regardless of the correction factor any particular automatic printer algorithm may apply, lower printer saturation parameters will always lead to lower residual print color bias. The printer saturation parameter can be minimized for the same negative imagewise exposed under different lighting conditions, by maintaining similar red, green, blue density relationships under all illuminants of interest. In the case of a color negative film which may be exposed under fluorescent lighting or daylight, this means the film should have a low printer saturation parameter under those conditions. Since the amount of dye produced by any coupler in a color record will depend on the sensitization of the layer in which it is located, this implies controlling the sensitization of each layer so that it will be sufficiently similar under daylight or fluorescent lighting.

The present invention also realizes that most fluorescent lights have a narrow strong emission at 435 nm and relatively low emission between 450–500 nm. In order to obtain prints in automatic printers which do not have high color bias, from color negatives which use tabular silver halide grains in the blue sensitive layer, regardless of whether they are exposed under daylight or fluorescent light, the tabular emulsion is therefore sensitized with at least two spectral sensitizing dyes so as to have good sensitivity both at 435 nm as well as to the longer blue wavelengths between 450–500 nm.

Accordingly, the present invention provides a color photographic element comprising a blue sensitive tabular grain silver halide emulsion layer the halide content of which is less than 80% chloride and which has a tabularity of at least 8, the emulsion being sensitized such that the wavelength of maximum sensitivity of the emulsion between 400–500 nm ("$\lambda_{Bmax}$"), the sensitivity at 485 nm ("$S_{485}$"), the sensitivity at 410 nm ("$S_{410}$"), and the sensitivity at $\lambda_{Bmax}$ ("$S_{Bmax}$"), are defined by:

$$430\text{ nm} \geqq \lambda_{Bmax} \geqq 440\text{ nm or } 450\text{ nm} \geqq \lambda_{Bmax} \geqq 480\text{ nm}$$

and:

$$S_{485} \geqq 50\%(S_{Bmax})$$

$$S_{410} \geqq 60\%(S_{Bmax})$$

and the maximum sensitivity of the emulsion between 430–440 nm ("$S_{(430-440)max}$"), and the maximum sensitivity between 450–480 nm ("$S_{(450-480)max}$"), have the following relationship:

$$90\%\ (S_{(450-480)max}) \geqq S_{(430-440)max} \geqq 110\%\ (S_{(450-480)max}).$$

It will be seen from the above that $S_{(430-440)max}$ is therefore within± 10% of $S_{(450-480)max}$.

The present invention also provides a process of printing a positive from a subject color negative on the foregoing type of photographic element (particularly such negatives that have been exposed under fluorescent lighting). The method comprises printing the negative in a printer which measures color densities and evaluates the difference in color densities of the subject negative relative to a standard negative, and automatically adjusts the amount of red, green or blue light exposure (or any two, or all three) for the subject negative based on the difference in color densities so that the print produced from the subject negative will have a color balance closer to that of an optimum color balance of a print produced from the standard negative. By "automatically adjusts" is meant that the printer can carry out the necessary adjustment without operator manual adjustment, according to a preset suitable algorithm (which algorithm itself may be varied by a printer operator).

Film neutral gamma (that is, the slope of the DlogE curve) affects film densities. Lowering film gamma will therefore decrease the printer saturation parameters. However, for a given film neutral gamma, the present invention can provide a lower printer saturation parameter and lower the color bias of a print printed from a negative in an automatic printer.

DRAWINGS

Figure 2:
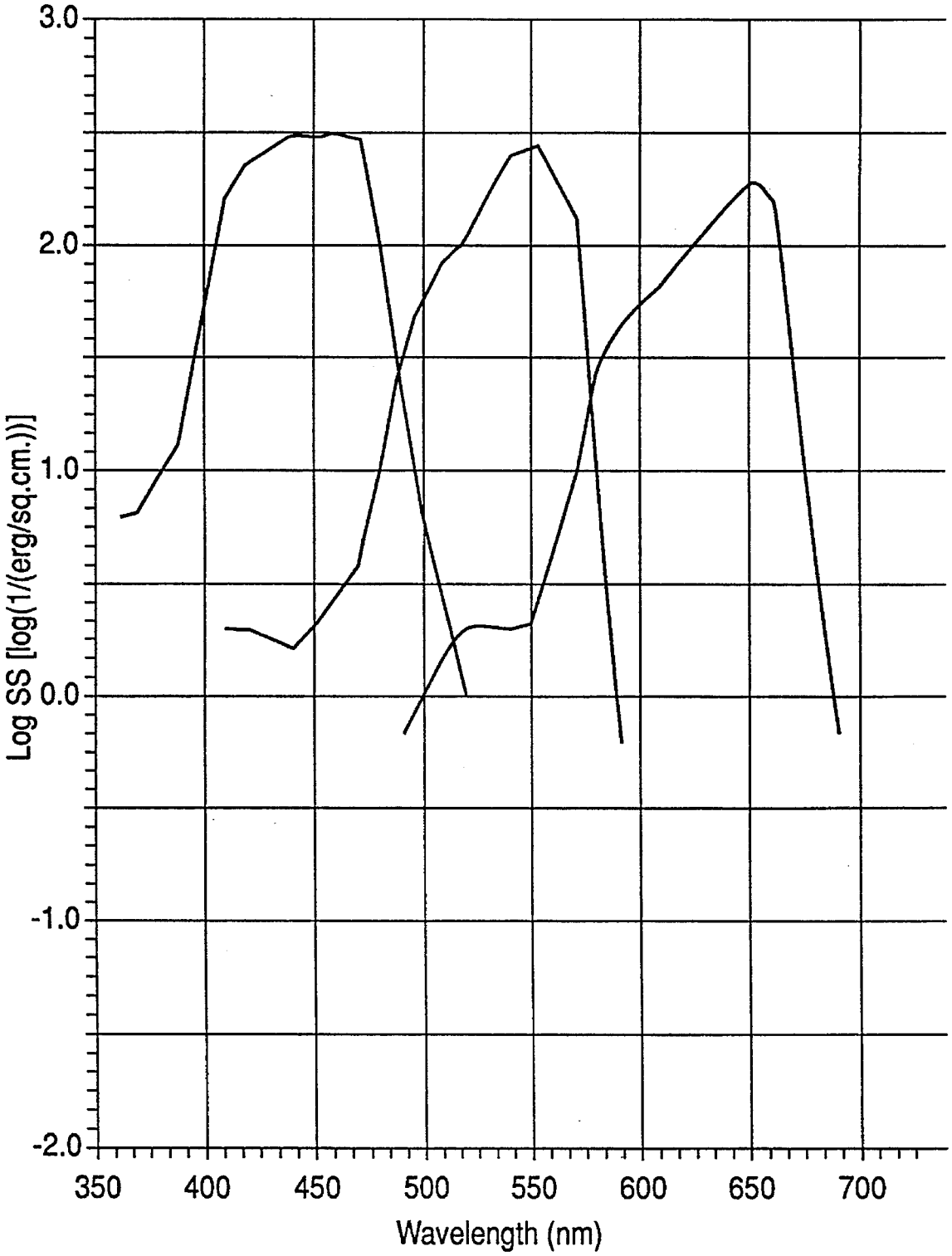

FIG. 1 is a blue spectral sensitivity and typical green and red spectral sensitivity of a comparative color negative film; and FIG. 2 is the blue spectral sensitivity and typical green and red spectral sensitivity of a color element of the present invention.

EMBODIMENTS OF THE INVENTION

It will be appreciated that in the above method, the "standard negative" could be almost any negative which reproduces a gray card well when exposed under daylight. The standard negative referred to herein can be a negative the same as the subject negative or one the same except for the spectral sensitization of the blue sensitive layer. Thus, the standard negative will usually have an all tabular grain silver halide emulsion layer or layers for the blue sensitive record, and each of which has been sensitized with a sensitizing dye to the 450–500 nm region only. However, in practice typical standard negatives are derived from a population of negatives of a kind which the printer is likely to process (for example, consumer pictures), the standard negative in such a case being that one which has statistically averaged red, green and blue densities based on such a population. An "optimum color balanced print" produced from the standard negative is a print which is obtained from a standard negative when the negative is given the red, green and blue light exposures required such that the print has the same color balance as the gray card (in the first case) or the statistically averaged red, green and blue densities of the population (in the second case).

A color element of the above type is typically a negative element (in that it is designed to form a negative image following processing), and may have various red and green spectral sensitivity profiles. However, it is preferred that it has a maximum red sensitivity of between 600–660 nm. Within the foregoing range, maximum red sensitivities between 600–640 nm or between 640–660 nm can be used. Preferably the red sensitivity of the red sensitive record of the element is between 600–640 nm. Using the 600–640 nm range allows the element to have a red sensitivity more similar to that of the human eye and to better match the emission spectra of fluorescent lights As to the green sensitive record of the element, this should preferably have a maximum sensitivity between 530–570 nm. Preferably, the tabular grain emulsion has a blue sensitivity at a wavelength of 485 nm ("$S_{485}$"), such that $S_{485} \geqq 30\%$ ($S_{Bmax}$). More particularly, the foregoing could be $\geqq 20\%(S_{Bmax})$. Also, the $S_{410}$ could be $\geqq 50\%(S_{Bmax})$ or even $\geqq 40\%$ or $\geqq 20\%$ of $S_{Bmax}$. Similarly, $S_{(430-440)max}$, could be within $\pm 8\%$ or even $\pm 4\%$ of $S_{(450-480)max}$. It will be understood in this application that when any sensitivity parameters of a particular emulsion, layer or record of an element is referenced, this means the sensitivity as measured in the element.

As to the silver halide tabular emulsion used for the blue sensitive layer, it is preferably a silver bromoiodide emulsion in which the iodide content of the emulsion is less than 15% and the chloride content is less than 10%. Unless otherwise indicated throughout this application, all percentages are by moles.

A color negative of the above defined type will usually have a blue record made up of one or more blue sensitive layers. Typically, each blue sensitive layer will be of the type defined above (that is, a blue sensitive tabular grain silver halide emulsion layer of the type and sensitivity defined above). However, the present invention can include the possibility of a blue sensitive layer being other than the defined blue sensitive tabular grain silver halide emulsion.

As to the printing process, the automatic printer typically adjusts the red exposure, $E_r$, green exposure, $E_g$, or blue exposure, $E_b$, (this includes adjustment of any two or all three, as required) based on the difference in color saturation of the subject negative relative to a standard negative, D'. Typical automatic printers on which a film of the present invention may be printer, include those described above which have printer algorithms set for: (1) no color correction; (2) a 50% or some other percentage color correction; (3) or hue dependent color correction. These three types of color correction are described in more detail below:

(1) No Color Correction

The printer assesses the overall negative density relative to the setup negative (that is, the standard negative). The printer changes the R, G, and B exposures ("R", "G" and "B" refer to red, green and blue, respectively) to compensate for the deviation in average negative density from that of the setup negative, but the ratios of R, G, and B exposures for the new negative exposure to those for the setup negative are the same (Red ratio= Green ratio= Blue ratio, R'/R= G'/G= B'/B; where R', G' and B' indicate the exposures given to the standard negative during printing and R, G, and B indicate the exposures to the subject negative).

(2) 50% (or some percent signifcantly less than 100%, usually if not always less than 75%) Color Correction The printer assess the overall negative density relative to the normal setup negative and determines the R, G, and B exposure time ratios for the new negative relative to the setup negative. These exposure times are then adjusted to provide some color correction. The color correction is determined by calculating the color saturation of the new negative relative to the setup negative. One way which is commonly used to assess negative color saturation is described by E. Goll in the article referenced above (which is incorporated herein by reference). The average R, G, and B film densities are determined by the printer and compared to those for the setup negative. The density differences are calculated as described on page 95 of the reference. A T-space conversion matrix is applied to these density differences as described on page 97 of the reference. Finally, film saturation is calculated from these parameters as described on page 99 of the reference. After determining the negative saturation, the printer corrects for 50% of the film saturation by adjusting the R, G, and B exposures relative to what is needed for a neutral correction only. The actual adjustment of the R, G, and B exposures is accomplished using the film saturation value and the hue of the film saturation (described on page 99 of the reference), in a way which compensates for the hue of the negative (for example, if the film has a magenta bias, the green exposure is increased and the red and blue exposures are decreased to remove 50% of the color saturation in the negative on printing).

(3) Hue-dependent Color Correction

Printers using this kind of algorithm proceed exactly as the constant percent correction printers do until the film hue and saturation are calculated. The printer then makes a correction dependent on the hue of the film color bias relative to the setup negative, and from the saturation level of the film color bias. In this adaptive algorithm, the printer corrects maximally for small film color biases and to an increasingly smaller degree as the film color saturation increases. The amount of correction is determined by a printer color space (often called T-space) boundary. If the film color saturation is greater than the boundary, no color correction is made. The distance from the boundary to the central neutral point varies depending on the film color bias hue, in such a way as to allow the printer to make large corrections for film color biases which are introduced by typical illuminant variations, such as sunset and north skylight for daylight illumination. This kind of algorithm is described in detail in the article by E. Goll referenced above.

The necessary spectral sensitivity characteristics of the blue sensitive silver halide tabular grain emulsion defined above, can be obtained by using at least two sensitizing dyes. One of the dyes can provide a peak sensitivity on the emulsion between 430–440 nm, while the other provides a peak sensitivity on the emulsion between 450–480 nm. The amounts of such dyes used can then be adjusted to provide the relative maximum absorptions in those regions, defined above. Since the spectral absorption characteristics of a sensitizing dye on an emulsion will, to some extent, depend on the particular emulsion used as well as other sensitizing dyes present on the same emulsion, the sensitizing dyes selected to sensitize the blue sensitive tabular silver halide emulsion to within the required characteristics will have to be selected bearing in mind these characteristics. For example, by itself YD-26 shows a peak wavelength at 470 nm; when used in combination with YD-1 (a shorter dye) its peak wavelength shifted to 461 nm. By itself YD-1 shows a peak wavelength at 438 nm but this peak moves to 440 nm when combined with YD-26 at a 1:1 ratio. Furthermore, the spectral sensitivity can be manipulated not only by the dyes used but also through factors such as the order of addition, the environment (VAg), the emulsion surface and other factors. The dyes can be added as solutions or as dispersions as prepared by the means including the type of process outlined in Boettcher et al U.S. Pat. No. 5,217,859, and references therein. Potentially suitable dyes include those types described in T. H. James, editor, *The Theory of the Photographic Process,* 4th Edition, Macmillan, New York, 1977, Chapter 8, and in F. M. Hamer, *Cyanine Dyes and Related Compounds,* Wiley, New York, 1964, or U.S. Pat. No. 4,439,520, page 26 line 61 to page 34. Alternatively, one can blend the required type of emulsions each sensitized with different (short and long) sensitizing dyes, and the final blend (which is an emulsion as required by the present application) has the necessary blue spectral sensitivity profile. However, normally an emulsion meeting the sensitivity requirements of the present invention will be present in one layer (although, of course, in most films the blue sensitive record will have more than one blue sensitive layer each of which meets the requirements of the present invention but which are of different speed). Further preferably, all emulsions of the blue sensitive record are tabular grain emulsions of the type described herein.

Many spectral sensitizing dyes are capable of aggregating on bromide or iodobromide tabular grain surfaces at the 430–440 nm region, some particular examples are shown in Table 1. U.S. patent application entitled "Photographic Elements Containing Particular Blue Sensitized Tabular Grain Emulsion" by Reed et al., filed on the same date as the present application (U.S. Pat. No. 08/227,931), discloses dyes which can usefully sensitize in the foregoing region. Some examples of spectral sensitizing dyes sensitizing an emulsion in the 450–480 nm region are shown in Table 2.

TABLE 1

| | |
|---|---|
| YD-1 | Anhydro-5-chloro-5'-phenyl-3,3'-bis(3-sulfopropyl)oxathiacyanine hydroxide, triethylammonium salt. |
| YD-2 | 3,3'-Dimethyl-6-azanaphtho[1,2-d]thiazolocyanine p-toluenesulfonate. |
| YD-3 | Anhydro-5,6-dichloro-3-ethyl-1,1'-bis(3-sulfopropyl)benzimidazolonaphth[1,2-d]oxazolocyanine hydroxide, potassium salt. |
| YD-4 | Anhydro-5,5'di(methylthio)-3,3'bis(3-sulfopropyl)oxathiacyanine hydroxide, triethylammonium salt. |
| YD-5 | Anhydro-5'-methoxy-3,3'-bis(3-sulfopropyl)naphth[2,3-d]oxazolothiacyanine hydroxide triethylammonium salt. |
| YD-6 | 5,5'6,6'-Tetrachloro-1,1',3,3'-tetramethylbenzimidazolocyanine para toluenesulfonate. |
| YD-7 | 5,5',6,6'-tetrachloro-1,1'-dimethyl-3,3'-methylenebenzimidazolocyanine iodide. |
| YD-8 | Anhydro-3,3'-bis(3-sulfopropylnaphtho[1,2-d]-thiazolooxacyanine hydroxide triethylammonium salt. |
| YD-9 | Anhydro-3,3'-bis(3-sulfopropyl)-5-(2-thienyl)-oxa-4',5'-dihydronaphtho[1,2-d]thiazolocyanine hydroxide, triethylammonium salt. |

TABLE 2

| | |
|---|---|
| YD-10 | Anhydro-5,5'-dichloro-3-ethyl-3'-(3-sulfopropyl)thiacyanine hydroxide. |
| YD-11 | Anhydro-5-chloro-3'-ethyl-3-(3-sulfopropyl) naphtho[1,2-d]thiazolothiacyanine hydroxide. |
| YD-12 | Anhydro-5,5'-di(methylthio)-3,3'-bis(3-sulfopropyl)thiacyanine hydroxide, triethylammonium salt. |
| YD-13 | Anhydro-1'-ethyl-3-(3-sulfopropyl) naphtho[1,2-d]thiazolothiacyanine hydroxide. |
| YD-14 | Anhydro-5-chloro-3,3'-bis(3-sulfopropyl)thiacyanine hydroxide, triethylammonium salt. |

TABLE 2-continued

| | |
|---|---|
| YD-15 | Anhydro-3-(3-carboxypropyl)-5,5'-dichloro-3'-ethylthiacyanine hydroxide. |
| YD-16 | Anhydro-5'-methylthio-1,3'bis(3-sulfopropyl)naphtho[1,2-d]thiazolothiacyanine hydroxide, triethylamine salt. |
| YD-17 | Anhydro-5-chloro-3'-ethyl-3-(4-sulfobutyl)thiacyanine hydroxide. |
| YD-18 | Anhydro-5,5'-diphenyl-3,3'bis(3-sulfopropyl)-thiacyanine hydroxide, triethylammonium salt. |
| YD-19 | Anhydro-1,3'-bis(3-sulfopropyl)naphtho[1,2-d] thiazolothiacyanine hydroxide, triethylammonium salt. |
| YD-20 | Anhydro-5,5'-dimethoxy-3,3'-bis(3-sulfopropyl) thiacyanine hydroxide, sodium salt. |
| YD-21 | Anhydro-3-(2-carboxy-2-sulfoethyl)-3'-ethyl-5-methoxythiacyanine hydroxide, potassium salt. |
| YD-22 | Anhydro-1-ethyl-3'-(2-phosphonoethyl)naphtho[1,2-d]thiazolothiacyanine hydroxide. |
| YD-23 | Anhydro-3-ethyl-5'-methoxy-5-methylthio-3'-(3-sulfopropyl)thiacyanine hydroxide. |
| YD-24 | Anhydro-5-phenyl-3,3'bis(3-sulfopropyl)-4',5'-dihydronaphtho[1,2-d]thiazolothiacyanine hydroxide, triethylamine salt. |
| YD-25 | Anhydro-3-ethyl-5,5'-dimethyoxy-3'-(3-sulfopropyl)thiacyanine hydroxide. |
| YD-26 | Anhydro-5,5'-dichloro-3,3'-bis(3-sulfopropyl)thiacyanine hydroxide, triethylammonium salt. |

As already described above, color photographic elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art although the order described above (red sensitive on a transparent support first, followed by green sensitive then blue sensitive) is preferred. In a less preferred alternative format, the emulsions sensitive to each of the three primary regions of the spectrum can be disposed as a single segmented layer.

The element can contain additional layers, such as filter layers, interlayers, overcoat layers, subbing layers, antihalation layers and the like. All of these can be coated on a support which can be any suitable transparent support. Photographic elements of the present invention may also usefully include a magnetic recording material as described in *Research Disclosure,* Item 34390, November 1992, or a transparent magnetic recording layer such as a layer containing magnetic particles on the underside of a transparent support as in U.S. Pat. No. 4,279,945, and U.S. Pat. No. 4,302,523. The element typically will have a total thickness (excluding the support) of from 5 to 30 micrometers.

In the following discussion of suitable materials for use in elements of this invention, reference will be made to *Research Disclosure,* December 1989, Item 308119. This and other Research Disclosures references herein are published by Kenneth Mason Publications, Ltd., Dudley Annex, 12a North Street, Emsworth, Hampshire P010 7DQ, ENGLAND. *Research Disclosure,* December 1989, Item 308119, will be identified hereafter by the term "Research Disclosure I." The Sections hereafter referred to are Sections of the Research Disclosure I.

The silver halide emulsions employed in the elements of this invention will be negative-working, such as surface-sensitive emulsions or unfogged internal latent image forming emulsions. Suitable emulsions and their preparation as well as methods of chemical and spectral sensitization are described in Sections I through IV. Color materials and development modifiers are described in Sections V and XXI. Vehicles which can be used in the elements of the present invention are described in Section IX, and various additives such as antifoggants, stabilizers, light absorbing and scattering materials, hardeners, coating aids, plasticizers, lubricants and matting agents are described, for example, in Sections V, VI, VIII, X, XI, XII, and XVI. Manufacturing methods are described in Sections XIV and XV, other layers and supports in Sections XIII and XVII, processing methods and agents in Sections XIX and XX, and exposure alternatives in Section XVIII.

The photographic elements of the present invention may also use colored couplers (e.g. to adjust levels of interlayer correction) and masking couplers such as those described in EP 213,490; Japanese Published Application 58-172,647; U.S. Pat. No. 2,983,608; German Application DE 2,706,117C; U.K. Patent 1,530,272; Japanese Application A-113935; U.S. Pat. No. 4,070,191 and German Application DE 2,643,965. The masking couplers may be shifted or blocked.

The photographic elements may also contain materials that accelerate or otherwise modify the processing steps of bleaching or fixing to improve the quality of the image. Bleach accelerators described in EP 193,389; EP 301,477; U.S. Pat. No. 4,163,669; U.S. Pat. No. 4,865,956; and U.S. Pat. No. 4,923,784, are particularly useful. Also contemplated is the use of development accelerators or their precursors (UK Patent 2,097,140; U.K. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The elements may also contain filter dye layers comprising colloidal silver sol or yellow and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323.) Also, the couplers may be blocked or coated in protected form as described, for example, in Japanese Application 61/258,249 or U.S. Pat. No. 5,019,492.

The photographic elements may further contain other image-modifying compounds such as "Developer Inhibitor-Releasing" compounds (DIR's). Useful additional DIR's for elements of the present invention, are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

DIR compounds are also disclosed in "Developer-Inhibitor-Releasing (DIR) Couplers for Color Photography," C. R. Barr, J. R. Thirtle and P. W. Vittum in *Photographic Science and Engineering,* Vol. 13, p. 74 (1969), incorporated herein by reference.

The emulsions and materials to form elements of the present invention, may be coated on pH adjusted support as described in U.S. Pat. No. 4,917,994; with epoxy solvents (EP 0 164 961); with additional stabilizers (as described, for example, in U.S. Pat. No. 4,346,165; U.S. Pat. No. 4,540,653 and U.S. Pat. No. 4,906,559); with ballasted chelating agents such as those in U.S. Pat. No. 4,994,359 to reduce sensitivity to polyvalent cations such as calcium; and with stain reducing compounds such as described in U.S. Pat. No. 5,068,171 and U.S. Pat. No. 5,096,805. Other compounds useful in the elements of the invention are disclosed in Japanese Published Applications 83-09,959; 83-62,586; 90-072,629, 90-072,630; 90-072,632; 90-072,633; 90- 072,634; 90-077,822; 90-078,229; 90-078,230; 90- 079,336; 90-079,338; 90-079,690; 90-079,691; 90- 080,487; 90-080,489; 90-080,490; 90-080,491; 90- 080,492; 90-080,494; 90-085,928; 90-086,669; 90- 086,670; 90-087,361; 90-087,362; 90-087,363; 90- 087,364; 90-088,096; 90-088,097; 90-093,662; 90- 093,663; 90-093,664; 90-093,665; 90-093,666; 90-093,668; 90-094,055; 90-094,056; 90-101,937; 90-103,409; 90-151,577.

For the present invention employing red, green and blue sensitive layers, as already mentioned a blue sensitive layer must have a tabular grain emulsion of the type and sensitization already specified. However, for other layers of the element of the present invention (for example, red and green sensitive layers) the silver halide used in the photographic elements of the present invention may be silver iodobromide (preferred for all layers), silver bromide, silver chloride, silver chlorobromide, silver chloroiodobromide, and the like. The type of silver halide grains preferably include polymorphic, cubic, octahedral or tabular.

The range of iodide content in the silver bromoiodide tabular grain emulsion of the blue sensitive layer as required by the present invetion, can be 0.1% to 15%, preferably 0.2% to 9%, and most preferably 0.5% to 8%. The grain size of the silver halide may have any distribution known to be useful in photographic compositions, and may be ether polydispersed or monodispersed.

It will be understood in the present application, that tabular grain emulsions are those with two parallel major faces each clearly larger than any remaining grain face and tabular grain emulsions are those in which the tabular grains account for at least 30 percent, more typically at least 50 percent, preferably >70 percent and optimally >90 percent of total grain projected area. The tabular grains can account for substantially all (>97 percent) of total grain projected area. The tabular grain emulsions can be high aspect ratio tabular grain emulsions, that is ECD/t>8, where ECD is the diameter of a circle having an area equal to grain projected area and t is tabular grain thickness; intermediate aspect ratio tabular grain emulsions, that is ECD/t= 5 to 8; or low aspect ratio tabular grain emulsions, that is ECD/t= 2 to 5. The emulsions typically exhibit high tabularity (T) (where $T= ECD/t^2$), that is T> 8, where ECD and t are both measured in micrometers (μm). The tabularity, T, can even be greater than 40 or 50. The tabular grains can be of any thickness compatible with achieving an aim average aspect ratio and/or average tabularity of the tabular grain emulsion. Preferably the tabular grains satisfying projected area requirements are those having thicknesses of <0.3 μm, thin (<0.2 μm) tabular grains being specifically preferred. In the present invention, preferably the tabular grains used have a thickness of between 0.04 micrometers to 0.16 micrometeres, and preferably between 0.11 to 0.15 micrometeres.

High iodide tabular grain emulsions are illustrated by House U.S. Pat. No. 4,490,458, Maskasky U.S. Pat. No. 4,459,353 and Yagi et al EPO 0 410 410.

Tabular grains formed of silver halide(s) that form a face centered cubic (rock salt type) crystal lattice structure can have either {100} or {111} major faces. Emulsions containing {111} major face tabular grains, including those with controlled grain dispersities, halide distributions, twin plane spacing, edge structures and grain dislocations as well as adsorbed {111} grain face stabilizers, are illustrated by Wey U.S. Pat. No. 4,399,215, Maskasky U.S. Pat. Nos. 4,400,463, 4,684,607, 4,713,320, 4,713,323, 5,061,617, 5,178,997, 5,178,998, 5,183,732, 5,185,239, 5,217,858, and 5,221,602, Wey et al U.S. Pat. No. 4,414,306, Daubendiek et al U.S. Pat. Nos. 4,414,310, 4,672,027, 4,693,964 and 4,914,014, Abbott et al U.S. Pat. No. 4,425,426, Solberg et al U.S. Pat. No. 4,433,048, Wilgus et al U.S. Pat. No. 4,434,226, Kofron et al U.S. Pat. No. 4,439,520, Sugimoto et al U.S. Pat. No. 4,665,012, Yagi et al U.S. Pat. No. 4,686,176, Hayashi U.S. Pat. No. 4,748,106, Goda U.S. Pat. No. 4,775,617, Takada et al U.S. Pat. No. 4,783,398, Saitou et al U.S. Pat. Nos. 4,797,354 and 4,977,074, Tufano U.S. Pat. No. 4,801,523, Tufano et al U.S. Pat. No. 4,804,621, Ikeda et al U.S. Pat. No. 4,806,461 and EPO 0 485 946, Bando U.S. Pat. No. 4,839,268, Makino et al U.S. Pat. No. 4,853,322, Nishikawa et al U.S. Pat. No. 4,952,491, Houle et al U.S. Pat. No. 5,035,992, Piggin et al U.S. Pat. Nos. 5,061,609 and 5,061,616, Nakamura et al U.S. Pat. No. 5,096,806, Bell et al U.S. Pat. No. 5,132,203, Tsaur et al U.S. Pat. Nos. 5,147,771, '772, '773, 5,171,659, 5,210,013 and 5,252,453, Jones et al U.S. Pat. No. 5,176,991, Maskasky et al U.S. Pat. No. 5,176,992, Black et al U.S. Pat. No. 5,219,720, Antoniades et al U.S. Pat. No. 5,250,403, Zola et al EPO 0 362 699, Maruyama et al EPO 0 431 585, Urabe EPO 0 460 656, Verbeek EPO 0 481 133, 0 503 700 and 0 532 801, Jagannathan et al EPO 0 515 894 and Sekiya et al EPO 0 547 912. Emulsions containing {100} major face tabular grains are illustrated by Bogg U.S. Pat. No. 4,063,951, Mignot U.S. Pat. No. 4,386,156, Maskasky U.S. Pat. Nos. 5,264,337 and 5,275,930, Brust et al EPO 0 534 395 and Saitou et al EPO 0 569 971.

The silver halide grains to be used in the invention may be prepared according to methods known in the art, such as those described in *Research Disclosure I* and James, *The Theory of the Photographic Process,* or U.S. Pat. No. 4,439,520, for precipitation of iodobromide tabular grains. These include methods such as ammoniacal emulsion making, neutral or acid emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

The silver halide to be used in the invention may be advantageously subjected to chemical sensitization with noble metal (for example, gold) sensitizers, middle chalcogen (for example, sulfur) sensitizers, reduction sensitizers and others known in the art. Compounds and techniques useful for chemical sensitization of silver halide are known in the art and described in *Research Disclosure I* and the references cited therein.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like), and others as described in *Research Disclosure I.* Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, pollvinyl pyridine, methacrylamide copolymers, and the like, as described in *Research Disclosure I.* The vehicle can be present in the emulsion in any amount useful in photographic emulsions. The emulsion can also include any of the addenda known to be useful in photographic emulsions. These include chemical sensitizers, such as active gelatin, sulfur, selenium, tellurium, gold, platinum, palladium, iridium, osmium, rhodium, ruthenium, phosphorous, or combinations thereof. Chemical sensitization is generally carried out at pAg levels of from 5 to 10, pH levels of from 5 to 8, and temperatures of from 30° to 80° C., as illustrated in *Research Disclosure,* June 1975, item 13452 and U.S. Pat. No. 3,772,031.

The silver halide may be sensitized by sensitizing dyes of by any method known in the art, such as described in *Research Disclosure I.* Of course, the blue sensitive tabular silver halide emulsion will be sensitized to meet the requirements as described above. The dye or dyes may be added to an emulsion of the silver halide grains and a hydrophilic colloid at any time prior to (e.g., during or after chemical sensitization) or simultaneous with the coating of the emulsion on a photographic element. However, for tabular grain emulsions, the dye should be added preferably during chemical sensitization. The dye/silver halide emulsion may be mixed with a dispersion of color image-forming coupler immediately before coating or in advance of coating (for example, 2 hours).

Photographic elements of the present invention are preferably imagewise exposed using any of the known techniques, including those described in *Research Disclosure I,* section XVIII. This typically involves imagewise exposure to light in the visible region of the spectrum. Elements of the present invention are particularly useful for exposing under fluorescent lighting.

Photographic elements comprising the composition of the invention can be processed in any of a number of well-known photographic processes which form negative dye images, utilizing any suitable processing composition, described, for example, in *Research Disclosure I,* or in James, *The Theory of the Photographic Process* 4th, 1977. Preferred color developing agents are p-phenylenediamines. Especially preferred are:

4-amino N,N-diethylaniline hydrochloride, 4-amino-3-methyl-N,N-diethylaniline hydrochloride, 4-amino-3-methyl-N-ethyl-N-(β-(methanesulfonamido) ethylaniline sesquisulfate hydrate, 4-amino-3-methyl-N-ethyl-N-(β-hydroxyethyl)aniline sulfate, 4-amino-3-β-(methanesulfonamido)ethyl-N,N-diethylaniline hydrochloride and 4-amino-N-ethyl-N-(2-methoxyethyl)-m-toluidine di-p-toluene sulfonic acid.

Development is followed by bleach-fixing, to remove silver or silver halide, washing and drying.

Following the processing step, a negative of the present invention is then used to produce a print preferably on an automatic printer of the type, and in the manner, already described above.

The invention is described further in the following examples.

EXAMPLES

The improvement in color print quality as a result of the invention blue spectral sensitivity can only be illustrated in a full multi-color film format. EXAMPLE 1 is the comparative film which features blue sensitive tabular grain emulsions dyed with a preferred dye cited in U.S. Pat. No. 5,252,444. EXAMPLE 2 is an invention film which features similar tabular grain emulsions except the imaging emulsions are dyed to produce a spectral maximum at 440 nm and a second maximum at 461 nm.

EXAMPLES 1 and 2 share a common format as described below:

EXAMPLE 1 (Comparative)

The following layers were coated onto a clear acetate film support in the order cited: The amounts are in mg per square meter (mg/m$^2$):

| | |
|---|---|
| **Layer 1: Antihalation Layer** | |
| grey silver | 150.0 |
| gelatin | 1614.6 |
| UV dye UV-1 | 75.3 |
| UV dye UV-2 | 32.3 |
| sequestrant and antistain agents as needed | |
| **Layer 2: Low Sensitivity Red-Sensitive Emulsion Layer** | |
| cyan emulsion CE-1 | 538.2 |
| cyan emulsion CE-2 | 430.4 |
| gelatin | 1460.1 |
| Coupler-1 | 478.8 |
| Coupler-2 | 64.6 |
| Coupler-3 | 5.4 |
| **Layer 3: Middle Sensitivity Red-Sensitive Emulsion Layer** | |
| cyan emulsion CE-3 | 968.8 |
| gelatin | 1345.0 |
| Coupler-3 | 43.04 |
| Coupler-1 | 355.1 |
| Coupler-2 | 21.5 |
| Coupler-4 | 10.7 |
| **Layer 4: High Sensitivity Red-Sensitive Emulsion Layer** | |
| cyan emulsion CE-4 | 861.1 |
| gelatin | 968.8 |
| Coupler-3 | 43.0 |
| Coupler-1 | 96.8 |
| Coupler-5 | 43.0 |
| Coupler-4 | 16.2 |
| **Layer 5: Interlayer** | |
| gelatin | 850.8 |
| oxidized developer scavenger ODS | 75.3 |
| antistain agent, surfactants, and antifoggants as needed. | |
| **Layer 6: Low Sensitivity Green-Sensitive Emulsion Layer** | |
| magenta emulsion ME-2 | 495.0 |
| gelatin | 1184.0 |
| Coupler-6 | 301.3 |
| Coupler-7 | 75.3 |
| **Layer 7: Middle Sensitivity Green-Sensitive Emulsion Layer** | |
| magenta emulsion ME-3 | 914.9 |

-continued

| | |
|---|---|
| gelatin | 1162.5 |
| Coupler-6 | 145.3 |
| Coupler-7 | 53.8 |
| Coupler-8 | 26.9 |
| **Layer 8: High Sensitivity Green-Sensitive Emulsion Layer** | |
| magenta emulsion ME-4 | 753.5 |
| gelatin | 968.4 |
| Coupler-6 | 64.6 |
| Coupler-9 | 10.8 |
| Coupler-7 | 43.0 |
| **Layer 9: Yellow Filter Layer** | |
| gelatin | 860.8 |
| oxidized developer scavenger ODS | 75.3 |
| yellow filter dye YFD | 166.8 |
| antistain agent, surfactants and antifoggant as needed. | |
| **Layer 10: Low Sensitivity Blue-Sensitive Emulsion Layer** | |
| yellow emulsion YE-1 | 161.5 |
| yellow emulsion YE-2 | 107.6 |
| yellow emulsion YE-3 | 269.1 |
| gelatin | 2280.1 |
| Coupler-5 | 699.7 |
| Coupler-10 | 592.0 |
| Coupler-11 | 118.4 |
| Coupler-2 | 5.4 |
| Coupler-8 | 21.5 |
| **Layer 11: High Sensitivity Blue-Sensitive Emulsion Layer** | |
| yellow emulsion YE-4 | 559.7 |
| gelatin | 753.5 |
| Coupler-5 | 178.7 |
| Coupler-10 | 151.8 |
| Coupler-11 | 57.0 |
| Coupler-2 | 1.4 |
| Coupler-8 | 5.4 |
| **Layer 12: UV Absorbing Layer** | |
| UV dye UV-1 | 107.6 |
| UV dye UV-2 | 107.3 |
| gelatin | 699.7 |
| Lippmann Silverbromide | 215.3 |
| **Layer 13: Protective Overcoat Layer** | |
| gelatin | 888.0 |
| surfactants, lubricant, antistatic agent, soluble matte agent. | |
| Hardener bis(vinylsulfonylmethyl) ether is also added. | |

This format shows a triple coated magenta record and a triple coated cyan record. The results can be demonstrated with double coated records. Alternatively, the layer order as presented in Eeles et al U.S. Pat. No. 4,184,876, with the Fast Cyan above a slower magenta layer would also work. It is important to achieve for this example, consistent linear D LogE curves, the couplers and levels can be vaired. The magenta and cyan emulsions are also not critical, as long as they have the necessary curveshape (that is, so that all color records have consistent DlogE curves of the same gamma). Also, the cyan and magenta emulsions must show spectral sensitivity commonly observed in color films. For example, the maximum green spectral sensitivity should be in the range of 530–570 nm, the maximum red spectral sensitivity should be in the range of 590–670 nm. It is preferred that the magenta emulsions be tabular grain emulsions so that the red record acutance is less degraded than if conventional emulsions are used in the magenta record.

The material and amounts specified in Layers 10 and 11 will yield linear curveshape consistent with the density relationships of the magenta and cyan records to produce a balanced color film. Any other suitable means can be used to construct the red and green sensitive records.

EXAMPLE 2 (Invention)

EXAMPLE 2 was coated the same as EXAMPLE 1 with the following exceptions:

Emulsion YE-1 was replaced by Emulsion YE-1A.

Emulsion YE-2 was replaced by Emulsion YE-2A.

Emulsion YE-3 was replaced by Emulsion YE-3A.

Emulsion YE-4 was replaced by Emulsion YE-4A; the latter used at 699.4 mg/m$^2$.

The yellow emulsions in EXAMPLE 2 are exactly like those in EXAMPLE 1 except the spectral sensitizing dye used is YD-1 and YD-26 at a 1:1 molar ratio. Thus, the film elements of EXAMPLES 1 and 2 are the same except for their blue spectral sensitization.

Examples 3 and 4 below illustrate photographic elements of the present invention which have a maximum red spectral sensitivity in the 600–640 nm retion.

The following layers were coated over a clear acetate film support in the order cited. As in EXAMPLES 1 and 2, the amounts are in mg per square meter.

EXAMPLE 3 (Comparative)

| | |
|---|---|
| **Layer 1: Antihalation Layer** | |
| grey silver | 150.0 |
| UV dye UV-1 | 75.3 |
| gelatin | 2,421.0 |
| sequestrants and antistain agents as needed | |
| **Layer 2: Low Sensitivity Red-Sensitive Emulsion Layer** | |
| Cyan Emulsion CE-1 | 527.2 |
| Cyan Emulsion CE-5 | 527.2 |
| Coupler-2 | 53.8 |
| Coupler-1 | 538.0 |
| gelatin | 1,775.4 |
| **Layer 3: Middle Sensitivity Red-Sensitive Emulsion Layer** | |
| Cyan Emulsion CE-4A | 807.0 |
| Coupler-2 | 32.3 |
| Coupler-1 | 258.2 |
| Coupler-3 | 59.2 |
| Coupler-4 | 43.0 |
| gelatin | 1,614.0 |
| **Layer 4: High Sensitivity Red-Sensitive Emulsion Layer** | |
| Cyan Emulsion CE-6 | 860.8 |
| Coupler-1 | 96.8 |
| Coupler-3 | 45.2 |
| Coupler-4 | 43.0 |
| Coupler-12 | 5.4 |
| gelatin | 1,718.4 |
| **Layer 5: Interlayer** | |
| ODS-1 | 75.3 |
| gelatin | 860.8 |
| **Layer 6: Low Sensitivity Green-Sensitive Emulsion Layer** | |
| Magenta Emulsion ME-1 | 258.3 |
| Magenta Emulsion ME-5 | 516.5 |
| Coupler-6 | 247.5 |
| Coupler-7 | 32.3 |
| gelatin | 1,667.8 |
| **Layer 7: Middle Sensitivity Green-Sensitive Emulsion Layer** | |
| Magenta Emulsion ME-6 | 1,022.2 |
| Coupler-6 | 129.1 |
| Coupler-7 | 64.6 |
| Coupler-9 | 2.7 |
| Coupler-13 | 10.8 |
| gelatin | 1,571.0 |
| **Layer 8: High Sensitivity Green-Sensitive Emulsion Layer** | |
| Magenta Emulsion ME-7 | 1,129.8 |
| Coupler-6 | 96.8 |
| Coupler-7 | 53.8 |
| Coupler-9 | 2.2 |
| Coupler-13 | 37.7 |
| gelatin | 1,398.8 |
| **Layer 9: Yellow Filter Layer** | |
| YFD | 134.5 |
| ODS | 107.6 |
| gelatin | 860.8 |
| **Layer 10: Low Sensitivity Blue-Sensitive Emulsion Layer** | |
| Yellow Emulsion YE-5 | 484.2 |
| Coupler-5 | 742.9 |
| Coupler-10 | 161.4 |
| Coupler-11 | 32.3 |
| Coupler-14 | 5.4 |
| gelatin | 1,775.4 |
| **Layer 11: High Sensitivity Blue-Sensitive Emulsion Layer** | |
| Yellow Emulsion YE-6 | 376.6 |
| Coupler-5 | 236.7 |
| Coupler-10 | 139.9 |
| Coupler-11 | 64.6 |
| Coupler-14 | 5.4 |
| gelatin | 1,076.0 |
| **Layer 12: Protective Overcoat** | |
| Lippmann Silver Bromide | 107.6 |
| UV dye UV-1 | 107.6 |
| UV dye UV-2 | 107.6 |
| gelatin | 1,076.0 |
| Hardener Bis(vinylsulfonylmethy) ether was added. | |

EXAMPLE 4 (Invention) is identical to EXAMPLE 3 with the following exceptions:

| |
|---|
| **Layer 10: Low Sensitivity Blue-Sensitive Emulsion Layer** |
| Yellow emulsion YE-5 is replaced with YE-5A |
| **Layer 11: High Sensitivity Blue-Sensitive Emulsion Layer** |
| Yellow Emulsion YE-6 is replaced with YE-6A |

A description of the emulsions used the EXAMPLES is shown in Table 3

TABLE 3

| Emulsion | Iodide Content % | Grain Diameter ECD | Tabularity | Sensitizing Dyes | Dye Ratio |
|---|---|---|---|---|---|
| CE-1 | 1.3 | 0.54 | 77 | CD-1:CD-2 | 1 to 9 |
| CE-2 | 4.1 | 0.73 | 51 | CD-1:CD-2 | 1 to 9 |
| CE-3 | 4.1 | 0.93 | 73 | CD-1:CD-2 | 1 to 9 |
| CE-4 | 4.1 | 1.25 | 87 | CD-1:CD-2 | 1 to 9 |
| CE-4A | 4.1 | 1.25 | 87 | CD-3:CD-2 | 2 to 1 |
| CE-5 | 4.1 | 0.86 | 109 | CD-3:CD-2 | 2 to 1 |
| CE-6 | 4.1 | 2.6 | 149 | CD-3:CD-2 | 2 to 1 |
| ME-1 | 1.3 | 0.54 | 77 | MD-1:MD-2 | 1 to 3 |
| ME-2 | 2.6 | 0.75 | 57 | MD-1:MD-2 | 1 to 3 |
| ME-3 | 4.1 | 1.05 | 79 | MD-1:MD-2 | 1 to 3 |
| ME-4 | 4.1 | 1.25 | 87 | MD-1:MD-2 | 1 to 3 |
| ME-5 | 4.1 | 0.69 | 46 | MD-1:MD-2 | 1 to 3 |
| ME-6 | 4.1 | 1.06 | 120 | MD-1:MD-2 | 1 to 3 |
| ME-7 | 4.1 | 1.26 | 87 | MD-1:MD-2 | 1 to 3 |
| YE-1 | 1.3 | 0.54 | 77 | YD-26 | |
| YE-1A | 1.3 | 0.54 | 77 | YD-26:YD-1 | 1 to 1 |
| YE-2 | 1.5 | 1 | 59 | YD-26 | |
| YE-2A | 1.5 | 1 | 59 | YD-26:YD-1 | 1 to 1 |
| YE-3 | 4.1 | 1.3 | 77 | YD-26 | |

TABLE 3-continued

| Emulsion | Iodide Content % | Grain Diameter ECD | Tabularity | Sensitizing Dyes | Dye Ratio |
|---|---|---|---|---|---|
| YE-3A | 4.1 | 1.3 | 77 | YD-26:YD-1 | 1 to 1 |
| YE-4 | 4.1 | 2.6 | 149 | YD-26 | |
| YE-4A | 4.1 | 2.6 | 149 | YD-26:YD-1 | 1 to 1 |
| YE-5 | 2.7 | 1.38 | 625 | YD-26 | |
| YE-5A | 2.7 | 1.38 | 625 | YD-26:YD-3 | 1 to 1 |
| YE-6 | 2.7 | 2.29 | 658 | YD-26 | |
| YE-6A | 2.7 | 2.29 | 658 | YD-26:YD-3 | 1 to 1 |

The emulsion preparation procedure is well known, for example see U.S. Pat. No. 4,439,520, or U.S. Pat. No. 5,272,048. For emulsions CE-1, ME-1, ME-2, YE-1, YE-1A, YE-2 and YE-2A, the iodide is added at 70% of the precipitation. Emulsions YE-5, YE-5A, YE-6 and YE-6A have the iodide added during the interval of 17 to 95% of the precipitation. The remainer of the emulsions in the EXAMPLES are run dump iodide of which 1.1% is added through 70% of the precipitation and 3% is added at the point. All the emulsions follow a typical sulfur and gold chemical sensitization and a spectral sensitization with the respective sensitizing dyes.

CD-1 is Anhydro-9-ethyl-5,5'-dimethyl-3,3'-bis(3-sulfopropyl)thiacarbocyanine hydroxide, triethylamine salt.

CD-2 is Anhydro-5,5'-dichloro-9-ethyl-3,3'bis(3-sulfopropyl)thiacarbocyanine hydroxide, ion salt.

CD-3 is Anhydro-9-ethyl-3-methyl-5'-phenyl-3'-(4-sulfobutyl)thiacarbocyanine hydroxide.

MD-1 is Anhydro-6,6'-dichloro-1,1'-diethyl-3,3'bis( 3-sulfopropyl)-5,5'-ditrifluoromethylbenzimidazolocarbocyanine hydroxide, sodium salt.

MD-2 is Anhydro-5-chloro-9-ethyl-5'-phenyl-3'-( 3-sulfobutyl)-3-(3-sulfopropyl)oxacarbocyanine hydroxide, sodium salt.

Other film components are as follows:

UV-1 is 3-(Di-n-hexylamino)allylidene malononitrile.

UV-2 is 2-Propenoic acid, 2-cyano-3-(4-methoxyphenyl)-, propyl ester.

YFD is 1-Butanesulfonamide, N-(4-(4-cyano-2-(2-furanylmethylene)- 2,5-dihydro-5-oxo-3-furanyl)phenyl)-.

Coupler-1 is Hexanamide,2-(2,4-bis(1,1-dimethylpropyl)phenoxy)-N-( 4-((((4-cyanophenyl)amino)carbonyl)amino)-3-hydroxyphenyl)-.

Coupler 2 is Propanoic acid, 3-((3-(((4-(2,4bis(1,1-dimethylpropyl)phenoxy)butyl)amino)carbonyl)- 4-hydroxy 1-naphthalenyl)thio)-.

Coupler 3 is 2-Naphthalenecarboxamide, 1-hydroxy-4-(4-(((1-(( 4-methoxyphenyl)methyl)-1H-tetrazol-5-yl) thio)methyl)-2-nitrophenoxy)-N-(2-(tetradecyloxy)phenyl)-.

Coupler 4 is 2,7-Naphthalenedisulfonic acid, 5-(acetylamino)- 3-((4-((3-(((4-(2,4-bis(1,1-dimethylpropyl)phenoxyl)butyl)amino)carbonyl)- 4-hydroxy-1-naphthalenyl)oxy)phenyl)azo)-4-hydroxy-, disodium salt.

Coupler-5 is Benzoic acid, 4-chloro-3-((2-(4-ethoxy- 2,5-dioxo-3-(phenyl)methyl)-1-imidazolidinyl)-4,4-dimethyl-1,3-dioxopentyl)amino-,dodecyl.

Coupler 6 is Tetradecanamide, N-(3-((4-((2-((2-(2,4-bis- ( 1,1-dimethylpropyl)phenoxy)-1-oxobutyl)amino)phenyl)thio)- 4,5-dihydro-1-(2,4,6-trichlorophenyl)- 1H-pyrazol-3-yl)amino)-4-chlorophenyl)-.

Coupler-7 is Tetradecanamide, N-(4-chloro-3-((4-((3,4-dimethoxyphenyl)azo)- 4,5-dihydro-5-oxo-1-(2,4,6-trichlorophenyl)- 1H-pyrazol-3-yl)amino)phenyl)-2-(3-(1,1-dimethylethyl)- 4-hydroxyphenoxy)-.

Coupler 8 is 2-Naphthalenecarboxamide, 1-hydroxy-4-(2-nitro- 4-(((1-phenyl-1H-tetrazol-5-yl)thio)methyl)phenoxy)-N-( 2-(tetradecyloxy)phenyl)-.

Coupler-9 is Butanamide, 2- (2,4-bis(1,1-dimethylpropyl)phenoxy)-N-( 4-(4,5-dihydro-5-oxo-4-((1-phenyl- 1H-tetrazol-5-yl)thio)-3-(1-pyrolidinyl)-1H-pyrazol- 1-yl)phenyl)-.

Coupler-10 is Benzoic acid, 4-chloro-3-((2-(4-ethoxy-2,5-dioxo-3-(phenylmethyl)-1-imidazolidinyl)-3-(4-methoxyphenyl)- 1,3-dioxopropyl)amino)-, dodecyl ester.

Coupler-11 is 1H-Tetrazole-1-acetic acid, 5-(((((2-(1-(((2-chloro-5-((hexadecylsulfonyl)amino)phenyl)amino)carbonyl)- 3,3-dimethyl-2-oxobutoxy)-5-nitrophenyl)methyl)ethylamino)carbonyl)thio)-,propyl ester.

Coupler 12 is Naphthalenecarboxamide, 4-((1-ethyl)-1H-tetrazol- 5-yl)thio)-1-hydroxy-N-(2-tetradecyloxy)phenyl)-.

Coupler 13 is 1H-tetrazole-1-acetic acid, 5-(((4-((3-(aminocarbonyl)- 4-hydroxy-1-naphthalenyl)oxy)-3-((hexadecylsulfonyl))amino)phenyl)methyl)thio)-, propyl ester.

Coupler 14 is Propanoic acid, 3-(((2-dodecyloxy-5-methylphenyl)amino)carbonyl)- 4-hydroxy-1-naphthalenyl)thio).

ODS is 1,4-Benezenediol, 2,5-bis ( 1,1,3,3-tetramethylbutyl)-.

It is very important that the examples show the same linear curveshape for all three records because the overall color reproduction is also dependent on careful balance of the three records. After verifying that each film had the same gamma values for corresponding color records (for example: the red gamma of one film is the same as the red gamma of the other film; the green gamma of one film is the same as the green gamma of the other film, and the blue gamma of one film is the same as the blue gamma of the other film), the spectral sensitivity of each film was measured. FIG. 1 shows the spectral sensitivity of the film element of EXAMPLE 1. Note that the EXAMPLE 1 film element has a narrow blue spectral sensitivity profile with a peak wavelength at 470 nm. FIG. 2 shows the spectral sensitivity of the film element of EXAMPLE 2. Note that the Example 2 film has a broader blue sensitivity profile than the negative of EXAMPLE 1. In particular, the Example 2 film (invention) has a peak sensitivity at 440 nm and another peak at 461 nm. The height of the two peaks are about equal. The sensitivity at 485 nm is less than 50% of the maximum sensitivity and the sensitivity at 410 nm is less than 60% of either the peak at 440 nm or 461 nm.

Each of several light sources was used to photograph a gray target with the two films which differ only in the shape of the blue spectral sensitivity. The light sources included Warm White Deluxe fluorescent, Cool White fluorescent, Ultralume (economy fluorescent), Mercury Vapor lights and a simulated daylight ("HMI"). The films were processed in standard C-41 chemistry as described in British Journal of Photography Annual 1979 pg 204. A Kodak KDPS automatic printer was then used to measure the printer saturation parameter of each negative exposed under each light source when the printer is set up on the film exposed under the simulated daylight. That is, the Example 1 film which photographed the gray target under the simulated daylight, was used as the standard negative (that is, D' was set to O for this negative) for the Example 1 film which photographed the gray target under the other lighting considitions. Similarly, the Example 2 film which photographed the gray film frame exposed under the simulated daylight illumination served as the standard negative for the Example 2 film which photographed the gray target under the other lighting conditions.

The exposed negatives were then printed in an automatic printer with two different settings of the printer correction algorithm (50% or 100% chromatic correction) to illustrate the advantages in final print color balance when negatives of the present invention are printed versus other negatives. For the film of each Example, the procedure consisted of (1) setting up the printer using as a standard negative, the negative from the film of the same example used to photograph the gray card under the an HMI simulated daylight so that the printer produced a perfect gray print on KODAK Edge photographic paper, and (2) using the automatic printer mechanism to print the exposed negatives made under the illuminants described using either (A) 50% chromatic correction or (B) 100% chromatic correction and the subject failure suppression (SFS) boundary described in Goll et al. reference, above. Procedure A is typical of a modern minilab operation while procedure B is typical of modern high volume photofinishing operation. The T-space boundary (described above) used in the examples below where procedure (B) was used (hue dependent color correction), was defined by the following points in T-space:

| Hue | Saturation | Hue |
|---|---|---|
| 9 | 100 | 12 |
| 21 | 35 | 31 |
| 39 | 500 | 42 |
| 69 | 55 | 71 |
| 100 | 35 | 114 |

The status A densities of the resulting prints were measured, and trilinear plotting analysis was used to determine the magnitude and direction of the residual color print balance. The values of the printer saturation and residual print balance are tabulated below. The film peak sensitivities are summarized below in Table 4 (two numbers indicate two peaks at the indicated wavelengths).

The films of Examples 2 and 4 are inventive films, while those of Examples 1 and 3 are comparatives. The films of Examples 1 and 2 have matched red, green and blue gamma values. The films of Example 3 and 4 also have matched red, green and blue gamma values, but the gamma values of Example 3 and 4 films are higher than those of the films of Examples 1 and 2. The values for each light source are provided in Table 5 below.

The print color balance and printer saturation for each film exposed under each light source, and printed with either 50% correction or hue dependent correction (as described above) are listed below in Table 5. As pointed out above, the films exposed under simulated daylight were used as the standard negatives. Average values for each film exposed under the different lighting conditions are given on the line labeled "Average". CIELab values were obtained using the 1976 CIELab color space caluclations recommended in CIE Publication 15.2. Such calculations are also described in *Measuring Colour* R. W. G. Hunt, 1987 (published by Ellis Horwood Limited, Chichester, West Sussex, England).

TABLE 4

| Film from Example | Wavelength of Maximum Blue Sensitivity | Wavlength of Maximum Green Sensitivity | Wavelength of Maximum Red Sensitivity |
|---|---|---|---|
| EXAMPLE 1 (C) | 470 nm | 547 nm | 655 nm |
| EXAMPLE 2 (I) | 440 nm and 461 | 547 nm | 655 nm |
| EXAMPLE 3 (C) | 472 nm | 549 | 630 |
| EXAMPLE 4 (I) | 438 nm and 470 nm | 549 | 630 |

(I) = invention; (C) = comparative

TABLE 5

| Sample | Illuminant | Film of Example | Average Printer Saturation | 50% Correction Residual Print Balance CIELAB | Hue Dependent Correction Risidual Print Balance CIELAB |
|---|---|---|---|---|---|
| 1 (C) | WWD | 1 | 51 | 36 | 59 |
| 2 (C) | U30 | 1 | 41 | 29 | 54 |
| 3 (C) | CW | 1 | 17 | 18 | 18 |
| 4 (C) | MV | 1 | 22 | 21 | 27 |
| | AVERAGE | 1 | 33 | 26 | 40 |
| 5 (I) | WWD | 2 | 44 | 31 | 38 |
| 6 (I) | U30 | 2 | 36 | 25 | 46 |
| 7 (I) | CW | 2 | 15 | 17 | 15 |
| 8 (I) | MV | 2 | 14 | 17 | 14 |
| | Average | 2 | 27 | 23 | 28 |
| 9 (C) | WWD | 3 | 54 | 38 | 65 |
| 10 (C) | U30 | 3 | 48 | 33 | 59 |
| 11 (C) | CW | 3 | 20 | 16 | 20 |
| 12 (C) | MV | 3 | 33 | 24 | 43 |
| | Average | 3 | 39 | 28 | 47 |
| 13 (I) | WWD | 4 | 41 | 31 | 39 |
| 14 (I) | U30 | 4 | 41 | 31 | 47 |
| 15 (I) | CW | 4 | 15 | 17 | 15 |

TABLE 5-continued

| Sample | Illuminant | Film of Example | Average Printer Saturation | 50% Correction Residual Print Balance CIELAB | Hue Dependent Correction Risidual Print Balance CIELAB |
|---|---|---|---|---|---|
| 16 (I) | MV | 4 | 9 | 12 | 7 |
| | Average | 4 | 27 | 23 | 27 |

WWD = Philips Warm White Deluxe fluorescent bulb
U30 = Philips Ultralume 30 fluorescent bulb
CW = Philips Cool White fluorescent bulb
MV = Mercury Vapor lamp Reviewing the results from Table 5, it will be seen that each inventive film, when exposed under any of the described lights and processed in the automatic printer, provided a lower printer saturation value than a film not meeting the requirements of the present invention. Further, regardless of the type of printer correction, lower saturation values, as expected, lead to lower residual print color balance. Also, the type of printer correction algorithm used did not change this result. For example, this can be seen by comparing samples 1 and 5, or 11 and 15, or any other combination of inventive and non-inventive films exposed under the same lighting conditions, regardless of the printer correction used.

While the invention has been described in detail with particular reference to preferred embodiments, it will be understood that variations and modifications can be effected within the spirit and scope of the invention.

We claim:

1. A color photographic element comprising a blue sensitive tabular grain silver halide emulsion layer the halide content of which is less than 80% chloride end which has a tabularity of at least 8, the emulsion being sensitized by at least two sensitizing dyes such that the wavelength of maximum sensitivity of the emulsion between 400–500 nm ("$\lambda_{Bmax}$"), the sensitivity at 485 nm ("$S_{485}$"), the sensitivity at 410 nm ("$S_{410}$"), and the sensitivity at $\lambda_{Bmax}$ ("$S_{Bmax}$"), are defined by:

$$430\text{ nm} \geqq \lambda_{Bmax} \geqq 440\text{ nm or } 450\text{ nm} \geqq \lambda_{Bmax} \geqq 480\text{ nm}$$

and:

$$S_{485} \geqq 50\%(S_{Bmax})$$

$$S_{410} \geqq 60\%(S_{Bmax})$$

and the maximum sensitivity of the emulsion between 430–440 nm ("$S_{(430-440)max}$"), and the maximum sensitivity between 450–480 nm ("$S_{(450-480)max}$"), have the following relationship:

$$90\%(S_{(450-480)max}) \geqq S(_{430-440)max} \geqq 110\%(S_{(450-480)max}).$$

2. A color photographic element according to claim 1 wherein the halide content of the blue sensitive tabular emulsion is less than 10% chloride and less than 15% iodide.

3. A color photographic element according to claim 1 wherein $S_{485} \geqq 30\%(S_{Bmax})$.

4. A color photographic element comprising a red sensitive silver halide emulsion layer containing a coupler which produces a cyan dye upon reaction with oxidized developer, a green sensitive silver halide emulsion layer containing a coupler which produces a magenta dye upon reaction with oxidized developer, and a blue sensitive silver halide emulsion layer containing a coupler which produces a yellow dye upon reaction with oxidized developer, the blue sensitive silver halide layer being a silver bromoiodide tabular grain emulsion the halide content of which is less than 15% iodide and less than 10% chloride and which emulsion has a tabularity of at least 8 and is sensitized by at least two sensitizing dyes such that the wavelength of maximum sensitivity of the emulsion between 400–500 nm ("$\lambda_{Bmax}$"), the sensitivity at 485 nm ("$S_{485}$"), the sensitivity at 410 nm ("$S_{410}$"), and the sensitivity at $\lambda_{Bmax}$ ("$S_{Bmax}$"), are defined by:

$$430\text{ nm} \geqq \lambda_{Bmax} \geqq 440\text{ nm or } 450\text{ nm} \geqq \lambda_{Bmax} \geqq 480\text{ nm}$$

and:

$$S_{485} \geqq 50\%(S_{Bmax})$$

$$S_{410} \geqq 60\%(S_{Bmax})$$

and the maximum sensitivity of the emulsion between 430–440 nm ("$S_{(430-440)max}$"), and the maximum sensitivity between 450–480 nm ("$S_{(450-480)max}$"), have the following relationship:

$$90\%(S_{(450-480)max}) \geqq S_{(430-440)max} \geqq 110\%(S_{(450-480)max}).$$

5. A color photographic negative according to claim 4 wherein the two sensitizing dyes are both monomethine cyanine dyes.

6. A color photographic element according to claim 1 wherein the element has a maximum red sensitivity of between 600–660 nm.

7. A color photographic element according to claim 1 wherein the element has a maximum red sensitivity of between 600–640 nm.

8. A color photographic element according to claim 1 wherein the blue sensitive tabular grain silver halide emulsion is a silver bromoiodide emulsion the halide content of which is less than 10% iodide and less than 10% chloride.

9. A color photographic element according to claim 1 wherein the blue sensitive tabular grain silver halide emulsion is sensitized such that:

$$S_{485} \geqq 30\%(S_{Bmax}).$$

* * * * *

UNITED STATES PATENT AND TRADEMARK OFFICE

CERTIFICATE OF CORRECTION

PATENT NO. : 5,460,928 Page 1 of 2

DATED : October 24, 1995

INVENTOR(S) : Mamie Kam-Ng et. al.

It is certified that error appears in the above-indentified patent and that said Letters Patent is hereby corrected as shown below:

Abstract on Cover, line 9, "$430nm \geqq \lambda_{Bmax} \geqq 440nm$ or $450nm \geqq \lambda_{Bmax} \geqq 480nm$" should read --$430nm \leq \lambda_{Bmax} \leq 440nm$ or $450nm \leq \lambda_{Bmax} \leq 480nm$--

Abstract on Cover, line 11, "$S_{485} \geqq 50\%(S_{Bmax})$" should read --$S_{485} \leq 50\%(S_{Bmax})$--

Abstract on Cover, line 12, "$S_{410} \geqq 60\%$" should read --$S_{410} \leq 60\%(S_{Bmax})$--

Abstract on Cover, line 17, "$90\%(S_{(450-480)max}) \geqq S_{(430-440)max} \geqq 110\%(S_{(450-480)max})$" should read --$90\%(S_{(450-480)max}) \leq S_{(430-440)max} \leq 110\%(S_{(450-480)max})$--

Col. 3, line 65, "$430nm \geqq \lambda_{Bmax} \geqq 440nm$ or $450nm \geqq \lambda_{Bmax} \geqq 480nm$" should read --$430nm \leq \lambda_{Bmax} \leq 440nm$ or $450nm \leq \lambda_{Bmax} \leq 480nm$--

Col. 4, line 1, "$S_{485} \geqq 50\%(S_{Bmax})$" should read --$S_{485} \leq 50\%(S_{Bmax})$--

Col. 4, line 2, "$S_{410} \geqq 60\%(S_{Bmax})$" should read --$S_{410} \leq 60\%(S_{Bmax})$--

Col. 4, line 9, "$90\%(S_{(450-480)max}) \geqq S_{(430-440)max} \geqq 110\%(S_{(450-480)max})$" should read --$90\%(S_{(450-480)max}) \leq S_{(430-440)max} \leq 110\%(S_{(450-480)max})$--

Col. 5, line 18, "S485 > 30%(SBmax)" should read --S485 < 30%(SBmax)--

Col. 5, line 19, "> 20%(SBmax)" should read --< 20%(SBmax)--

Col. 5, line 20, "$\geqq 50\%(S_{Bmax})$ or even $\geqq 40\%$ or $\geqq 20\%$ of $S_{Bmax}$" should read --$\leq 50\%(S_{Bmax})$ or even $\leq 40\%$ or $\leq 20\%$ of $S_{Bmax}$--

Col. 21, line 36, "end" should read --and--

Col. 21, line 45, "$430nm \geqq \lambda_{Bmax} \geqq 440nm$ or $450nm \geqq \lambda_{Bmax} \geqq 480nm$" should read --$430nm \leq \lambda_{Bmax} \leq 440nm$ or $450nm \leq \lambda_{Bmax} \leq 480nm$--

UNITED STATES PATENT AND TRADEMARK OFFICE

CERTIFICATE OF CORRECTION

PATENT NO. : 5,460,928

DATED : October 24, 1995

INVENTOR(S) : Mamie Kam-Ng et. al.

It is certified that error appears in the above-indentified patent and that said Letters Patent is hereby corrected as shown below:

Col. 21, line 49, "$S_{485} \geqq 50\%(S_{Bmax})$" should read --$S_{485} \leq 50\%(S_{Bmax})$--

Col. 21, line 50, "$S_{410} \geqq 60\%(S_{Bmax})$" should read --$S_{410} \leq 60\%(S_{Bmax})$--

Col. 21, line 56, "$90\%(S_{(450\text{-}480)max}) \geqq S_{(430\text{-}440)max} \geqq 110\%(S_{(450\text{-}480)max})$" should read --$90\%(S_{(450\text{-}480)max}) \leq S_{(430\text{-}440)max} \leq 110\%(S_{(450\text{-}480)max})$--

Col. 21, line 62, "$S_{485} \geqq 30\%(S_{Bmax})$" should read --$S_{485} \leq 30\%(S_{Bmax})$--

Col. 22, line 31, "$430nm \geqq \lambda_{Bmax} \geqq 440nm$ or $450nm \geqq \lambda_{Bmax} \geqq 480nm$" should read --$430nm \leq \lambda_{Bmax} \leq 440nm$ or $450nm \leq \lambda_{Bmax} \leq 480nm$--

Col. 22, line 35, "$S_{485} \geqq 50\%(S_{Bmax})$" should read --$S_{485} \leq 50\%(S_{Bmax})$--

Col. 22, line 37, "$S_{410} \geqq 60\%(S_{Bmax})$" should read --$S_{410} \leq 60\%(S_{Bmax})$--

Col. 22, line 43, "$90\%(S_{(450\text{-}480)max}) \geqq S_{(430\text{-}440)max} \geqq 110\%(S_{(450\text{-}480)max})$" should read --$90\%(S_{(450\text{-}480)max}) \leq S_{(430\text{-}440)max} \leq 110\%(S_{(450\text{-}480)max})$--

Col. 22, line 62, "$S_{485} \geqq 30\%(S_{Bmax})$" should read --$S_{485} \leq 30\%(S_{Bmax})$--

Signed and Sealed this

Fifteenth Day of October, 1996

*Attest:*

Bruce Lehman

BRUCE LEHMAN

*Attesting Officer*

*Commissioner of Patents and Trademarks*